US005749038A

United States Patent [19]

Fromm et al.

[11] Patent Number: 5,749,038

[45] Date of Patent: May 5, 1998

[54] TENSION CONTROL FOR A CLEANING WEB IN A FUSER SUBSYSTEM IN AN ELECTROPHOTOGRAPHIC PRINTER

[75] Inventors: Paul M. Fromm, Rochester; Edward C. Hanzlik, Fairport, both of N.Y.

[73] Assignee: Xerox Corporation, Stamford, Conn.

[21] Appl. No.: 837,935

[22] Filed: Apr. 11, 1997

[51] Int. Cl.[6] ..... G03G 21/00

[52] U.S. Cl. ..... 399/327; 15/256.51; 242/538.1

[58] Field of Search ..... 399/326, 327, 399/352; 242/538.1; 15/256.5, 256.51

[56] References Cited

U.S. PATENT DOCUMENTS 5,049,944 9/1991 DeBolt et al. ..... 355/284

5,200,785 4/1993 Hoover et al. ..... 355/282

5,212,529 5/1993 Morris et al. ..... 355/290

5,495,276 2/1996 Mul et al. ..... 347/164

*Primary Examiner*—Joan H. Pendegrass

*Attorney, Agent, or Firm*—R. Hutter

[57] ABSTRACT

An architecture of a fuser subsystem in an electrophotographic printer or copier includes a web which cleans the fuser roll. The web is driven by a mechanism which enables a constant velocity of the web relative to the fuser roll surface without the need of separate motor or controller. The design can further compensate for changes in frictional coefficient between the fuser roll and the web, such as is caused by large deposits of toner collected on the cleaning web.

9 Claims, 3 Drawing Sheets

FIG. 1
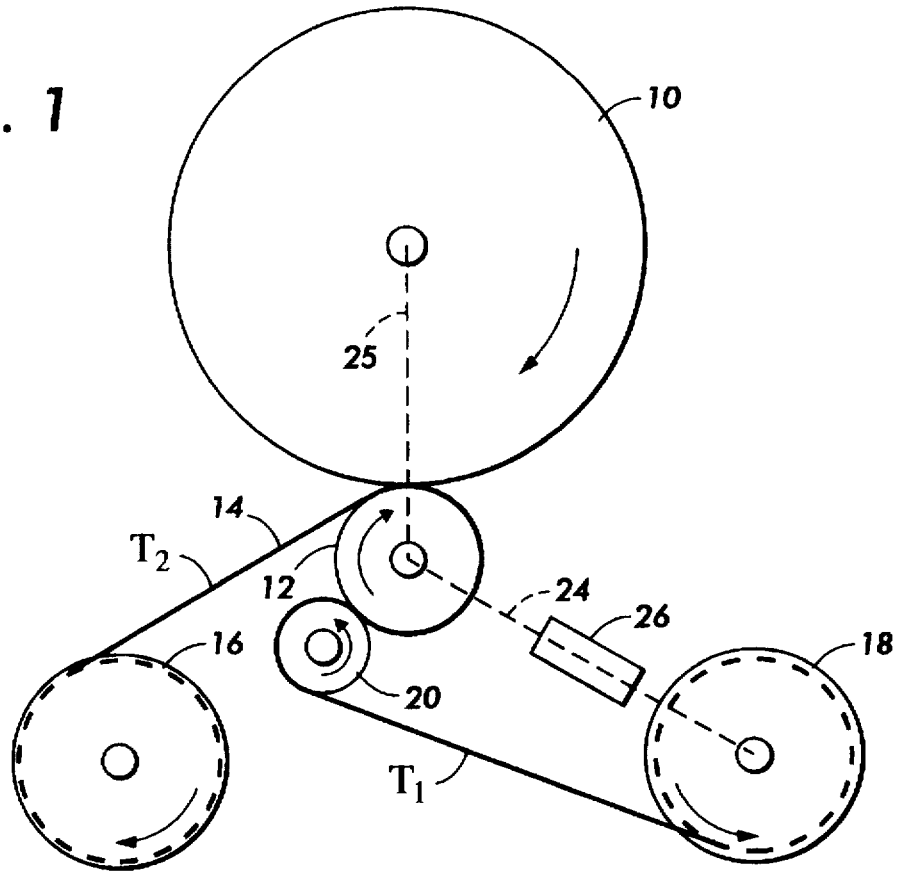
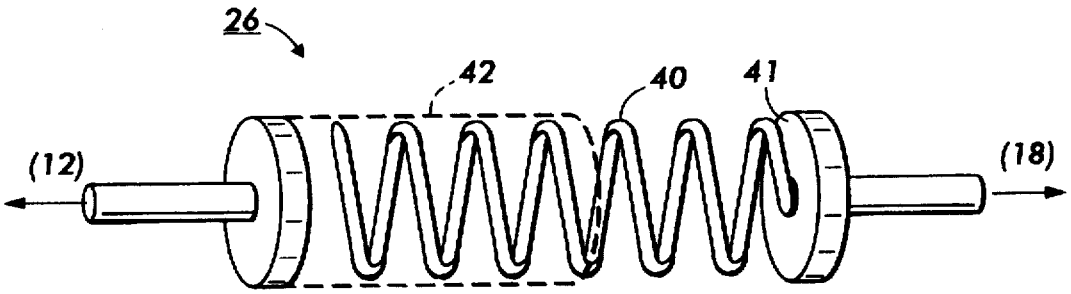
FIG. 2

TENSION CONTROL FOR A CLEANING WEB IN A FUSER SUBSYSTEM IN AN ELECTROPHOTOGRAPHIC PRINTER

FIELD OF THE INVENTION

The present invention relates to a fuser subsystem as would be found in an electrophotographic printer or copier, and specifically relates to an arrangement of rollers by which a cleaning web can be contacted with one of the rolls in the fuser subsystem.

BACKGROUND OF THE INVENTION

Fusing is an essential step in the well-known process of electrostatographic printing or copying. In the fusing step, powdered toner which has been transferred in imagewise fashion onto a medium, such as a sheet of paper, is fixed, typically by a combination of heat and pressure, on the medium to form a permanent image. The basic architecture of a fuser is well known: in essentials, a pressure roll rolls against a fuser roll, the image-bearing sheet passing through a nip between the rolls. The side of the medium having the image to be fixed typically faces the fuser roll, which is often supplied with a heat source, such as a resistance heater, at the core thereof. The combination of heat from the fuser roll and pressure between the fuser roll and pressure roll fixes the toner to form the permanent image.

In most fusing systems in use today, there is provided a system by which the fuser roll can be automatically cleaned and/or supplied with a lubricant or release agent. For high-volume applications, the release agent is typically supplied from an open supply of liquid release agent which is ultimately applied to the fuser roll through one or more donor rollers. In contrast, for mid- to low-volume applications, the cleaning and lubrication steps are provided to the surface of the fuser roll by means of a web which is urged against the surface of the fuser roll at a location generally away from the nip. The web provides a rough surface for removing excess toner particles from the surface of the fuser roll, and also provides amounts of lubricant or release agent. As is well-known, the function of the release agent is to prevent sheets passing through the nip from continuing to stick onto the surface of the fuser roll, which will cause a paper jam.

Generally, in most systems having a web for treating the fuser roll, the web is drawn from a replaceable spool and moved at a reasonably slow rate relative to the fuser roll, so that the motion of the fuser roll causes the surface of the fuser roll to rub against a small area of the web. The relatively slow motion of the web provides friction to the fuser roll and provides a supply of clean web at a reasonable rate. A typical ratio of surface speeds in, for example, a 60 ppm printer is approximately 300 millimeters per second for the outer surface of the fuser roll, compared to a speed of 2–3 millimeters per minute for the motion of the web.

In most prior art designs of a web feeder for a fuser subsystem, the web is drawn from a supply roll and pulled by a take-up roll. Typically, the take-up roll is driven slowly, and the supply roll idles passively. Many structures have been proposed for providing the necessary slow but continuous motion of the web: prior art techniques include supplying an external motor separate from the motor driving the fuser roll, or providing a solenoid or ratchet arrangement.

Another key practical problem with web feeding architecture is that, as more and more web is taken up by the take-up roll, the circumference of the take-up roll increases significantly, and, if the rotational speed of the take-up roll remains constant, the increase in circumference will cause a significant increase in the web speed in the course of the web life. This speed variation is a source of performance variation which is undesirable, and excessive speed wastes web.

Another consideration which is crucial to overall performance of a fuser web is the normal force between the web and the length of the fuser roll. The normal force should be high enough to permit the web to remove, largely by friction, excess toner particles from the surface of the fuser roll, but not so high as to cause tearing of the web, excessive tension in the web leading to damagingly high drive torque on the take-up roll, or other malfunction of the web in the nip between a nip roller and the fuser roll.

DESCRIPTION OF THE PRIOR ART

U.S. Pat. No. 5,049,944 discloses an apparatus in which a cleaning web is urged by a spring against a fuser roll. A control system is used to vary the operation of the motor moving the web so that there will be relatively constant web speed at the contact nip.

U.S. Pat. No. 5,200,785 describes a fusing subsystem in a replaceable cartridge. The cartridge includes the fusing roller, an oil-applying structure, a heating lamp, temperature sensors, and an access opening. The cartridge electrical connector mates with a receiving electrical connector in the image-forming apparatus.

U.S. Pat. No. 5,212,529 discloses a fuser subsystem in which a web is wrapped around a portion of the fuser roll. The web contacts the fuser over a relatively short wrap angle to reduce the torque required to drive the fuser roll. A biasing mechanism increases the pressure applied to the web at both the entrance and exit areas of the fuser.

U.S. Pat. No. 5,495,276 discloses a system for controlling the tension of a medium on which images are to be printed in a digital printer. A first roller moves the medium through the printer at a given velocity, while a second roller, placed after the first roller moves the web at a variable velocity, where the variable velocity has a maximum which is greater than the first roller's velocity. Power is applied to the second roller through a clutch. When the maximum amount of power is applied to the second roller, the clutch limits the variable linear velocity to that of the first roller's linear velocity.

SUMMARY OF THE INVENTION

According to one aspect of the present invention, there is provided a fusing apparatus for an electrostatographic printer, comprising a rotatable fuser roll, a nip roll adjacent to a length of the fuser roll, and a take-up roll. One end of a web is attached to the take-up roll, with a portion of the web being disposed between the first nip roll and the fuser roll. A drive train causes rotation of the first nip roll and the take-up roll, the drive train including a slip clutch which limits an amount of torque which the take-up roll can exert on the web.

According to another aspect of the present invention, there is provided a fusing apparatus for an electrostatographic printer, comprising a rotatable fuser roll, and a nip roll adjacent to a length of the fuser roll. The nip roll is mounted on a mounting structure, the mounting structure being associated with a fulcrum and having a spring associated therewith, so that the nip roll is caused to exert a torque force against the fuser roll.

BRIEF DESCRIPTION OF THE DRAWINGS

FIG. 1 is an elevational view showing the essential portions of a fuser subsystem, as would be found in an electrostatographic printer, incorporating the present invention;

FIG. 2 is a simplified perspective view of a slip clutch which can be used in conjunction with the present invention;

DETAILED DESCRIPTION OF THE INVENTION

Figure 3:
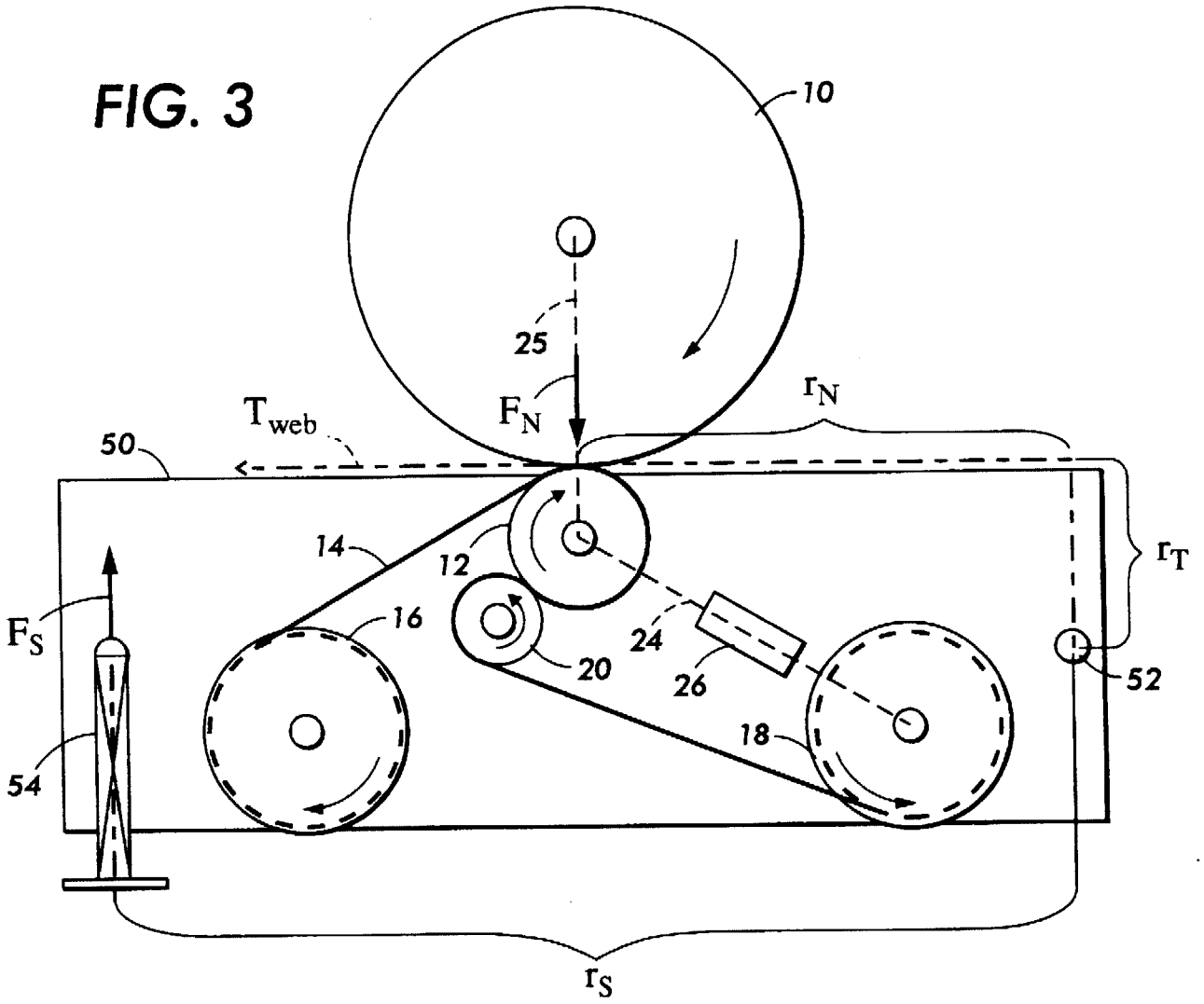
FIG. 3 is an elevational view showing the essential portions of a fuser subsystem, as would be found in an electrostatographic printer, showing another aspect of the present invention.

FIG. 1 is an elevational view showing the essential portions of a fuser subsystem, as would be found in an electrostatographic printer, incorporating the present invention. A fuser roll 10 rotates in the direction indicated. The fuser roll 10 typically shares a nip with a pressure roll (not shown), through which a medium bearing an image to be fused or fixed passes. Along one point of the circumference of fuser roll 10 a nip roll 12 urges a small area of a web 14 against a length of the fuser roll 10. A length of web 14 is drawn from a supply roll 16 and taken up on a take-up roll 18.

Further as shown in the Figure, there is provided what is called a "wrap" roll 20. As shown, the wrap roll 20 is configured with the nip roll 12 so that a quantity of web 14 wraps around a significant proportion of the circumference of nip roll 12. According to preferred embodiments of the present invention, the amount of wrap of web 14 should be more than 180° of the circumference of wrap roll 12, with a wrap of greater than 270° probably being impractical from an architecture standpoint. The significance of wrap roll 20 will be discussed in detail below.

Further shown in the Figure symbolically, by the dotted line marked 24, is a "drive train", that is, a structure, such as a gear box, pulley arrangement, or combination thereof, by which nip roll 12 and take-up roll 18 are commonly driven by a source of rotation (not shown). This source of rotation could be a motor dedicated to driving the two rolls, or more preferably is the same motor which ultimately drives fuser roll 10: dashed line 25 symbolizes a common drive arrangement, such as a gearbox, through which both fuser roll 10 and nip roll 12 could be driven by a common motor. Such a drive arrangement would have a speed reduction of approximately 3000–7000:1, comparable to the speed reductions commonly used in "clock motors."

The drive relationship between nip roll 12 and take-up roll 18 is preferably "rigid," that is, comprised purely of gears and/or pulleys, with the significant exception of the presence of a slip clutch here indicated as 26, the structure of which will be described in detail below. The presence of the drive relationship 24 and slip clutch 26 facilitates an important aspect of the present invention: The nip roll 12 should move the web against the surface of fuser roll 10 at a constant velocity, while maintaining take-up roll 18 at a constant torque. This constant torque produces a predictable varying web tension as the take-up roll 18 diameter grows. While the maintenance of a constant velocity on nip roll 12 is easily obtained by an external motor, maintenance of a predictable varying tension of web 14 is realized by causing take-up roll 18 to be driven at a constant torque. The constant torque on take-up roll 18 and the ability to change its rotational speed will obviate any problems which occur by the gradually increasing circumference of take-up roll 18.

FIG. 2 is a simplified view of one type of slip clutch 26 that can be effectively disposed between nip roll 12 and take-up roll 18. Slip clutch 26 includes a coil spring 40 which is rigidly attached to clutch output spindle 41, which in turn is rigidly anchored to the portion of the drive train 24 toward take-up roll 18. Attachment of coil spring 40 clutch output spindle 41 need be rigid only in the direction of web drive. The coil spring 40 is urged against, by virtue of the spring forces therein and the relative size of the coil spring 40 to the interior surface of a drum, shown in phantom as 42. Drum 42 is rigidly attached to the portion of the drive train 24 toward nip roll 12.

Because of the various gears, pulleys, etc., (not shown) in the drive train 24, the rotation on clutch 26 from the nip roll 12 side is preferably at least 15% faster than what is required for an empty (minimum radius) take-up roll 18 to move the web 14 at the desired constant velocity. As is generally known in the art of slip clutches, when there is high demand for torque on take-up roll 18, as will be explained below, the clutch output spindle 41 moves relative to the drum 42. Because of a particular winding of coil spring 40, when the coil spring 40 is turned relative to drum 42 in its direction of winding, the overall diameter of coil spring 40 gets smaller, and thereby substantially disengages from the inner surface of drum 42. This lack of radial force between coil spring 40 and the interior of drum 42 limits the torque drive train 24 can exert on take-up roll 18, thus limiting the tension on web 14 to a predictable range: the torque divided by the minimum and maximum radii of the take up roll 18. Although a spring-type slip clutch is here illustrated, other types of slip clutch, such as magnetic, are possible equivalents for this purpose.

The purpose of wrap roll 20, which maintains a relatively high proportion of the circumference of nip roll 12 wrapped in web 14, is to maintain a constant speed of web 14 by disallowing slip between the web 14 and the nip roll 12. As shown in FIG. 1, the tension $T_1$ of the web 14 at the indicated point relates to the tension $T_2$ at its indicated point by the equation:

$$T_2=T_1e^{a\mu}$$

where a is the wrap angle of the web 14 around the circumference of wrap roll 12, and μ is the frictional coefficient between web 14 and the surface of nip roll 12. A typical value of μ in this context is from 0.3 to 0.55, depending on the various materials used.

Frictional forces between the web 14 and fuser roll 10 caused by the loading of the nip roll 12 against the fuser roll 10, the coefficient of friction of the web 14 against the fuser roll 10, and the motion of the fuser roll 10 must be resisted by $T_2$ or the web 14 will move with the fuser roll 10. The coefficient of friction of the web 14 against the fuser roll 10 varies greatly (0.2–1.1) depending on the amount of toner and dirt on the web 14. The force of the nip roller 14 against the fuser roll 10 may or may not change during use of the system depending on configuration. $T_1$ varies predictably as the take up roll 18 changes radius and the clutch 26 slips. Thus when $T_1$ is at a minimum (when take up roll 18 is full) and fuser frictional force is a maximum, $T_2$ must be at least as large as the frictional force or the web 14 will either move with the fuser roll 10 or stop moving. Ensuring the wrap angle a is above the threshold where $T_2$ equals the frictional force from the fuser roll makes $T_2$ large enough to ensure proper motion of the web 14 against fuser oil 10, given the coefficient of friction of the web 14 against the nip roll 12.

Similarly, when $T_1$ is at a maximum (minimum take up roll 18 diameter) and the frictional force is at a minimum (very little toner and dirt and low load) the opposite failure mode may occur: web 14 will slide over nip roll 12. In this case $T_2$ is the sum of the frictional force between the web 14 and fuser roll 10 and the frictional force between the web 14 and the nip roll 12 acting on the other side of the web. (In the above discussion $T_2$ must resist the difference of these two frictional forces, but that detail can be omitted since the force on the fuser roll side dominates.) In this failure mode $T_2$ and $T_1$ are switched in the equation, and the maximum tension that will not make the web 14 slide on the nip roll 12 is found. Here again, more wrap angle a is better. Thus, the wrap roll 20 and the wrapping of the web 14 around the nip roll 12 increases the "latitude" of the system against variation in take-up roll 18 diameter, the coefficient of friction of the web 14 against the fuser roll 10, and unpredictable load variation between the nip roll 12 and fuser roll 10.

FIG. 3 is an elevational view showing another embodiment of the present invention. In FIG. 1 and FIG. 3, like reference numbers indicate like elements, and the overall function of the elements in FIG. 1 is the same in the FIG. 3 embodiment. The FIG. 3 embodiment further includes a provision that at least nip roll 12, and preferably the other rolls 16, 18, and 20, are mounted on a structure, here indicated as plate 50, which in turn is mounted on at least one pivoting fulcrum here indicated as 52. Also attached to structure 50 opposite fulcrum 52 is a spring 54, which can be of any design, which has the effect of urging nip roll 12 against the surface of fuser roll 10 with a force of $F_S$ as viewed from the spring 54 itself. The overall purpose of this arrangement is to enable compensation for friction variations between the web 14 and the fuser roll 10 by reducing the "normal" (radial) force between the nip roll 12 and the fuser roll 10 as the coefficient of friction thereof increases. Such variation in the frictional coefficient at this point are very common depending on how much waste toner is caused to stick on the surface of fuser roll 10 when a particular image is fixed in the fusing subsystem. In practical applications, the frictional coefficient can vary widely from 0.2 to 1.1. Sudden changes in the frictional coefficient will of course have a serious impact on the equilibrium of the system which is attempting to provide a constant velocity of web 14.

The operation of the fulcrum 52 and spring 54 to compensate for sudden changes in frictional coefficients on fuser roll 10 is as follows. FIG. 3 shows certain dimensions from which various torques will be calculated below: $r_N$ represents the radius between fulcrum 52 and the nip between nip roll 12 and fuser roll 10 along direction $T_{web}$ which is the direction of tension on the web 14 at the nip; $r_S$ represents the effective radius between fulcrum 52 and a selected point from which spring 54 exerts the force $F_S$; $r_T$ represents a radius between the fulcrum 52 and a line perpendicular to the nip formed by fuser roll 10 and nip roll 12; and finally $F_N$ represents the instantaneous normal force between fuser roll 10 and nip roll 12.

In a static case, where no rolls are moving, the torque of the structure 50 (the force $F_S$ times the radius relative to fulcrum 52) equals the normal force exerted against nip roll 12 by fuser roll 10 times its radius:

$$F_S r_S = F_N r_N$$

(The term that includes the effect of gravity on the mass of the assembly has been omitted from this and all subsequent equations to simplify the concept.) In the dynamic situation where the various rolls are moving and the friction of fuser roll 10 is exerted against web 14 creating thereby a tangential force on the web, the equation of torques is as follows:

$$F_S r_S = F_N r_N + F_t r_T$$

(The term that includes the drive torque input by drive train 24 has been omitted here and subsequently for clarity, but would be less than 30% of the total load.) The new tangential force $F_t$ is equal to the normal force on $F_N$ on the web times the instantaneous frictional coefficient $\mu_{(fr,\ web)}$ between the surface of the fuser roll 10 and the web 14, yielding the equation:

$$F_S r_S = F_N r_N + F_N \mu_{(fr,web)}$$

It will be noted in the above equation that the variable $\mu_{(fr,\ web)}$ is the unpredictable variable which will depend on the amount of excess toner on the fuser roll 10 at a particular time. $F_S$ will change only slightly, and in effect not at all, because there is usually only a slight deformation of spring 54. The various radius values are of course fixed. Thus, when the value $\mu_{(fr,web)}$ changes, the only variable that can compensate to maintain the equation is $F_N$. Rewriting the above equation, the value of $F_N$ varies as follows:

$$F_N = \frac{F_S r_S}{r_N + \mu_{(fr,\ web)} r_T}$$

In this way, the fulcrum 52 and spring 54 of this embodiment of the present invention facilitate a web feeding system which can maintain a constant velocity of web 14 regardless of sudden changes in the frictional coefficient on fuser roll 10 over a wider range of conditions than afforded with the wrap roll 20 employment alone.

Figure 4:
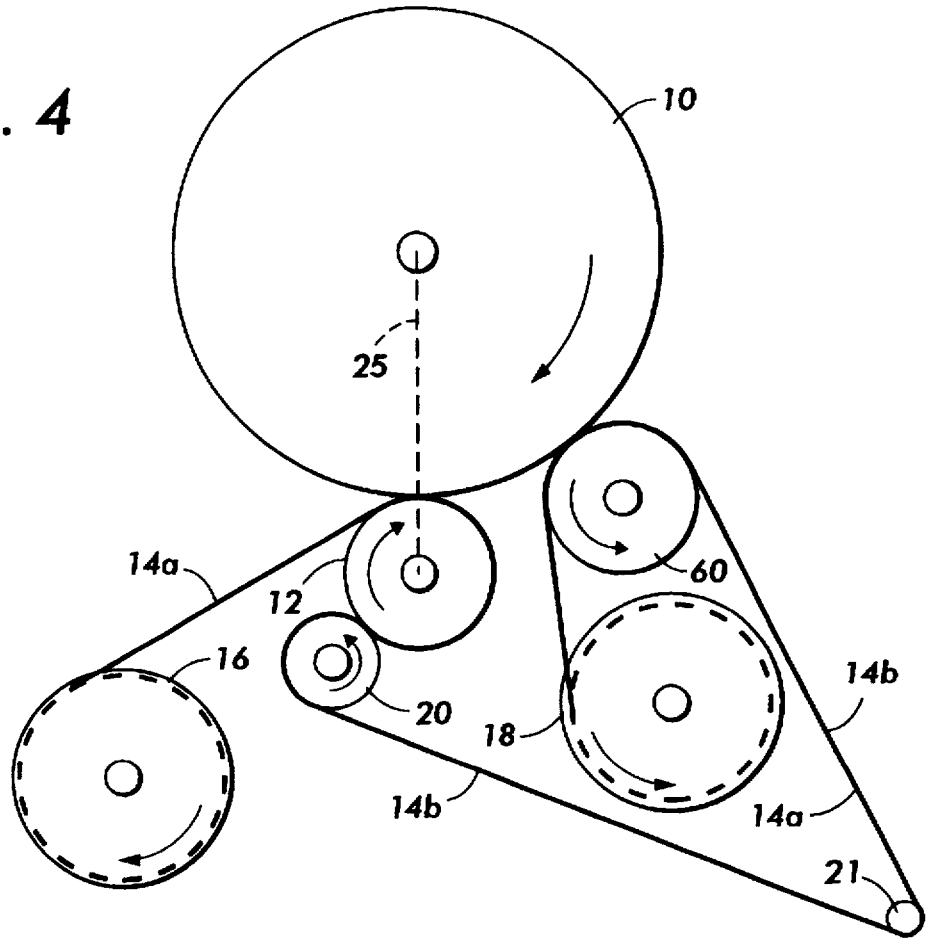
FIG. 4 is an elevational view showing the essential portions of a fuser subsystem, as would be found in an electrostatographic printer, showing another embodiment of the present invention.

FIG. 4 is a elevational view of the essential elements of an alternate embodiment of the present invention. In FIG. 4, like numerals represent like elements as in FIG. 1, with the difference being that, instead of the web 14 winding directly from wrap roll 20 to take-up roll 18, the web 14 extends from wrap roll 20 around a roll 21 (or equivalent structure, such as a curved plate) to a second nip roll, here indicated as 60. After winding over second nip roll 60, the web 14 is taken up by take-up roll 18 as in the previously described embodiments. Typically, the second nip roll 60 is moved purely by the action of the web 14 thereagainst, but it could conceivably be driven by a drive system as well. The roll 21 could alternately be omitted completely, allowing the web 14 to slide over the take up spool 18 with a very slight speed mismatch or stretch slightly between second nip roll 60 and take up spool 18.

In the view of FIG. 4, a spot on the surface of fuser roll 10, moving in the indicated direction, first encounters the web 14 on second nip roll 60, and then almost immediately thereafter, encounters the web 14 on nip roll 12. Several unique features are apparent in the configuration of FIG. 4. First, nip roll 12 and second nip roll 60 present opposite sides sides (each side indicated respectively here as **14*a* and 14*b*) of web 14 to the surface of fuser roll 10. This arrangement of course allows both sides of a web 14 to be used, which in turn can enable more efficient cleaning of the fuser roll 10, or permit web 14** to be moved at an even slower rate than in the above-described embodiments.

Secondly, it is significant that at the first encounter between the surface of fuser roll 10 and the web 14, at second nip roll 60, the rotation of the two rolls is with each other, as opposed to the case with nip roll 12, which rotates against the direction of rotation of fuser roll 10. A practical advantage of this arrangement is that, as the web 14 is moved toward take-up roll 18, the web material "downstream" of the nip between second nip roll 60 and fuser roll 10 will have already been used, and would therefore be dirty with toner that had been previously removed from fuser roll 10. Any excess toner(more than can be held in the "pore" structure or roughness of the web) frictionally removed from fuser roll 10 tends to roll or otherwise move through the nip at the urging of the fuser roll 10. In the case of the "with" rotation direction of the second nip roll 60, such excess toner encounters the previously-removed toner on the dirty portion of web 14. In other words, toner on fuser roll 10 which passes through the nip at second nip roll 60 will be pushed onto the dirty toner that is already on web 14. As toner always to some extent electrostatically is attracts other toner and hot toner is sticky and very preferentially sticks to other hot toner, this arrangement increases the overall cleaning efficiency at the nip formed by nip roll 60.

While the invention has been described with reference to the structure disclosed, it is not confined to the details set forth, but is intended to cover such modifications or changes as may come within the scope of the following claims.

We claim:

1. A fusing apparatus for an electrostatographic printer, comprising:

a fuser roll, rotatable in a first direction;

a first nip roll, a longitude of the nip roll being adjacent to a longitude of the fuser roll;

a take-up roll;

a web, one end of the web being attached to the take-up roll, and a portion of the web being disposed between the first nip roll and the fuser roll;

a drive train for causing rotation of the first nip roll and the take-up roll so that the web disposed between the first nip roll and the fuser roll moves in a direction opposite the first direction of the fuser roll, the drive train including a slip clutch associated with the take-up roll, the slip clutch limiting an amount of torque which the take-up roll can exert on the web.

2. The apparatus of claim 1, the web contacting the first nip roll over a wrap angle of at least 180 degrees.

3. The apparatus of claim 1, the drive train, when associated with a source of constant rotational velocity, causing the first nip roll to rotate at a constant rotational velocity.

4. The apparatus of claim 1, the drive train further causing rotation of the fuser roll.

5. The apparatus of claim 1, the nip roll being mounted on a mounting structure, the mounting structure being associated with a fulcrum and having a spring associated therewith, so that the nip roll is caused to exert a torque force against the fuser roll.

6. A fusing apparatus for an electrostatographic printer, comprising:

a rotatable fuser roll;

a nip roll, a length of the nip roll being adjacent to a length of the fuser roll;

the nip roll being mounted on a mounting structure, the mounting structure being associated with a fulcrum and having a spring associated therewith, so that the spring causes the nip roll to exert a constant torque force against the fuser roll.

7. The apparatus of claim 6, further comprising a web, a portion of the web being disposed between the first nip roll and the fuser roll;

the web contacting the first nip roll over a wrap angle of at least 180 degrees.

8. The apparatus of claim 6, further comprising a web, a portion of the web being disposed between the first nip roll and the fuser roll;

a take-up roll, one end of the web being attached to the take-up roll; and a drive train for causing rotation of the nip roll and the take-up roll, the drive train including a slip clutch associated with the take-up roll, the slip clutch limiting an amount of torque which the take-up roll can exert on the web.

9. A fusing apparatus for an electrostatographic printer, comprising:

a fuser roll;

a nip roll, a length of the nip roll being adjacent to a length of the fuser roll;

a web, a portion of the web being disposed between the first nip roll and the fuser roll;

a wrap roll, a length of the wrap roll being adjacent to a length of the nip roll, the web contacting the nip roll and the wrap roll so that the web contacts the nip roll over more than 180 degrees of a circumference of the nip roll.

* * * * *